US011067353B2

(12) United States Patent
Gheorghita

(10) Patent No.: US 11,067,353 B2
(45) Date of Patent: Jul. 20, 2021

(54) TRIGGER ASSEMBLY

(71) Applicant: Adrian Daniel Gheorghita, Bensalem, PA (US)

(72) Inventor: Adrian Daniel Gheorghita, Bensalem, PA (US)

( * ) Notice: Subject to any disclaimer, the term of this patent is extended or adjusted under 35 U.S.C. 154(b) by 70 days.

(21) Appl. No.: 16/410,344

(22) Filed: May 13, 2019

(65) Prior Publication Data

US 2020/0292265 A1 Sep. 17, 2020

(51) Int. Cl.
*F41A 19/10* (2006.01)

(52) U.S. Cl.
CPC ..... *F41A 19/10* (2013.01)

(58) Field of Classification Search
CPC ..... F41A 19/10
USPC ..... 42/69.01
See application file for complete search history.

(56) References Cited

U.S. PATENT DOCUMENTS

| | | | | |
|---|---|---|---|---|
| 4,835,893 | A | 6/1989 | Kelso | |
| 6,817,728 | B2 * | 11/2004 | Goko | F41A 33/02 362/111 |
| 8,656,619 | B2 | 2/2014 | Popikov | |
| 2011/0232150 | A1 * | 9/2011 | Zukowski | F41A 19/10 42/69.01 |
| 2013/0174459 | A1 | 7/2013 | Moretti | |
| 2016/0320155 | A1 * | 11/2016 | Singh | F41A 17/70 |
| 2018/0187993 | A1 | 7/2018 | Geissele | |
| 2020/0348098 | A1 * | 11/2020 | Galie | F41A 19/59 |

OTHER PUBLICATIONS

Iron Horse Innovation, Thumb Operated Receiver, Iron Horse Firearms, AR15, 2 pages, 2018.
Iron Horse TOR 1 5.56 Rifle 16" Barrel Semi Auto, Iron Horse Firearms, 3 pages (2018).
Sig Sauer, Operator's Manual: Handling & Safety Instructions, P320 X-Series, Updated Dec. 26, 2018, pp. 1-76.
Springfield Armory 1911-A1 Pistols; Operation and Safety Manual, Revised Feb. 16, 2016, 64 pages.
Springfield XD Operation and Safety Manual, Revised Jan. 8, 2015, 52 pages.

* cited by examiner

*Primary Examiner* — John Cooper
(74) *Attorney, Agent, or Firm* — Panitch Schwarze Belisario & Nadel LLP

(57) ABSTRACT

A trigger assembly suspends a trigger for rotation about both a first axis transverse to a longitudinal axis of a firearm barrel and a second axis parallel to the longitudinal axis of the firearm barrel. A support frame is mounted to a firearm frame and pivotable with respect to the firearm frame and the first axis. A support member is mounted to the support frame for movement therewith and has a support-member axis parallel to the longitudinal axis. A trigger-bar actuator extends from the support frame and is fixed thereto. A trigger arm is mounted to the support member and is pivotable with respect to the support member about the support-member axis. The trigger arm extends away from the support member at least in a direction perpendicular to the support-member axis and the transverse axis. The trigger is supported on the trigger arm for movement with the trigger arm.

13 Claims, 10 Drawing Sheets

TRIGGER ASSEMBLY

BACKGROUND

In the field of firearms, a firearm is fired by action of the user's finger upon a trigger of a trigger assembly. As seen in FIGS. 1 and 2, firearm in the form of a handgun 10 has a firearm barrel 12, a small portion of which is visible in solid lines, an additional, internal portion shown in dashed lines. The firearm barrel 12 defines an axis P parallel thereto. A vertical axis V runs generally vertically and perpendicular to the axis P. A transverse axis T runs generally horizontally and perpendicular to the vertical axis V. A trigger assembly 20 (FIG. 2) includes a trigger 22 rigidly connected to a transverse support member 24, which extends parallel to and is centered on the transverse axis T and is supported within the firearm frame (not shown) of the handgun 10 in a pair of trigger seats 14 (one is shown in FIG. 1), one on each side of the trigger 22. The trigger assembly 20 has the bore 24*a* aligned with the trigger seats 14 (and centered on the axis T), and the pin 26 is inserted through and through for mounting onto the firearm frame so that the trigger 22 is supported for single-axis rotation about the transverse axis T. A trigger-bar actuator 28 extends from the transverse support member 24 and is operatively connected to a trigger bar 30, a portion of which is shown in FIG. 2. The trigger bar 30 extends to operatively connect to the firing mechanism (not shown) of the handgun to control firing thereof.

Traditionally in the prior art, the trigger assembly 20 has been constructed so that the trigger 22 rotates solely about the transverse axis T passing through the transverse support member 24.

Where this traditional form of trigger assembly is employed, the user of the firearm must conform the movement of the user's trigger finger to the single-axis rotational movement of the trigger 22. The requirement that the user conform the movement of the user's trigger finger to the movement of the trigger 22 may cause tension for the user and possible small movements, especially lateral movement, of the front of the frame, which may in turn contribute to a reduction in the user's shooting accuracy.

BRIEF SUMMARY OF THE INVENTION

Briefly stated, in certain embodiments, a trigger assembly is provided for mounting to a firearm having a firearm frame and a firearm barrel. The firearm barrel defines a longitudinal axis. The trigger assembly comprises a support frame mounted to the firearm frame and pivotable with respect to the firearm frame with respect to a transverse axis oriented perpendicular to the longitudinal axis. A support member is mounted to the support frame for movement therewith and has a support-member axis that is coincident with or oriented parallel to the longitudinal axis. A trigger-bar actuator extends from the support frame and is fixed thereto. A trigger arm is mounted to the support member and is pivotable with respect to the support member about the support-member axis. The trigger arm extends away from the support member at least in a direction perpendicular to the support-member axis and the transverse axis. A trigger is supported on the trigger arm for movement with the trigger arm about the support-member axis.

In certain embodiments, a firearm comprises a firearm frame and a firearm barrel defining a longitudinal axis. A trigger assembly comprises a support frame mounted to the firearm frame and pivotable with respect to the firearm frame with respect to a transverse axis oriented perpendicular to the longitudinal axis. A support member is mounted to the support frame for movement therewith and has a support-member axis that is coincident with or oriented parallel to the longitudinal axis. A trigger-bar actuator extends from the support frame and is fixed thereto. A trigger arm is mounted to the support member and is pivotable with respect to the support member about the support-member axis. The trigger arm extends away from the support member at least in a direction perpendicular to the support-member axis and the transverse axis. A trigger is supported on the trigger arm for movement with the trigger arm about the support-member axis. A hand grip is attached to the firearm frame. The hand grip has a rearward portion with an outwardly protruding hand guide. The hand guide is located so that an index finger of a hand gripping the hand grip and arranged adjacent to the hand guide is aligned parallel to the firearm barrel when the index finger is extended into an operating position covering the center point 122*a* of the trigger 122.

In certain embodiments, a trigger assembly is provided for mounting to a firearm having a firearm frame and a firearm barrel. The trigger assembly comprises a trigger mounted for rotation about a first axis transverse to the barrel and about a second axis parallel to the firearm barrel.

BRIEF DESCRIPTION OF THE SEVERAL VIEWS OF THE DRAWINGS

The foregoing summary, as well as the following detailed description of certain aspects of this disclosure, will be better understood when read in conjunction with the appended drawings. For the purpose of illustrating the invention, there is shown in the drawings an example device according to the present disclosure. It should be understood, however, that the claimed invention is not limited to the precise arrangements and instrumentalities shown. In the drawings:

DETAILED DESCRIPTION OF THE SEVERAL VIEWS OF THE DRAWINGS

Figure 1:
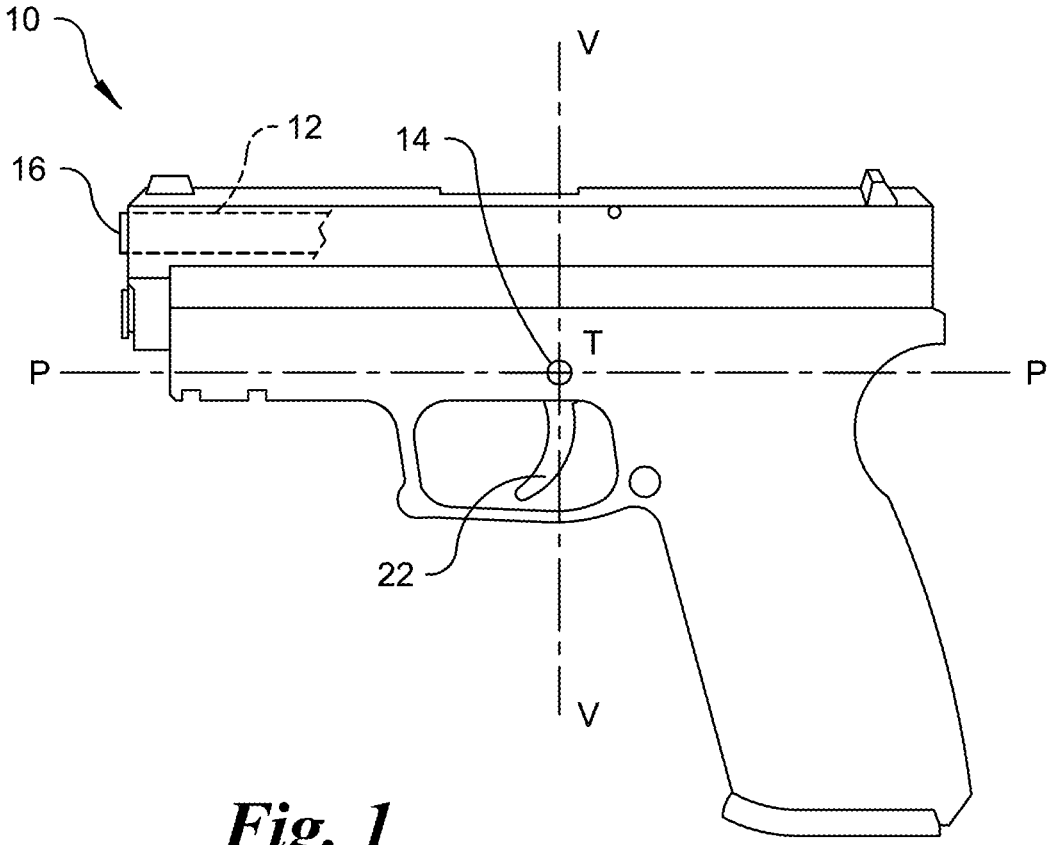
Fig. 1 (Prior Art)
FIG. 1 is a left side schematic view of a firearm illustrating certain elements of the prior art that are discussed in the "Background" section above.
Figure 2:
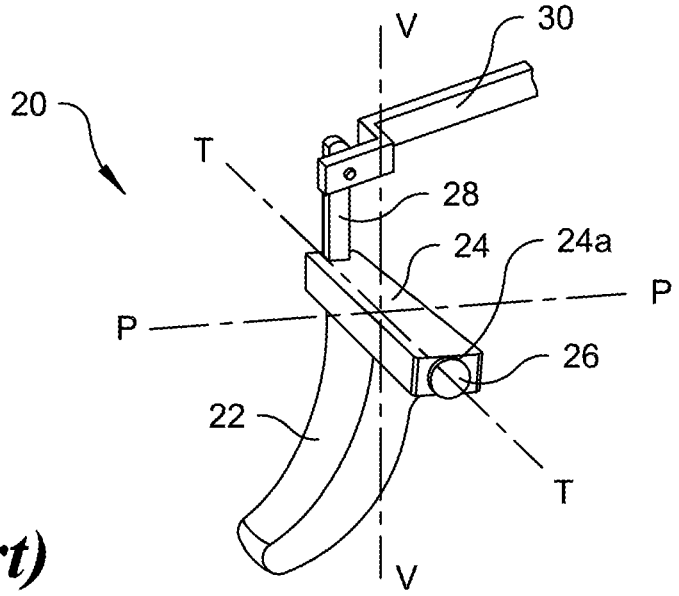
Fig. 2 (Prior Art)
FIG. 2 is a left front perspective view of a trigger assembly of the firearm of FIG. 1.

Certain terminology is used in the following description for convenience only and is not limiting. The words "right," "left," "lower," and "upper" designate directions in the drawings to which reference is made. The words "inwardly" or "distally" and "outwardly" or "proximally" refer to directions toward and away from, respectively, the geometric center or orientation of the device and instruments and related parts thereof. For the purposes of this application, a first axis is oriented parallel to a second axis if the two axes are either identical or are distinct and parallel; and a first axis is oriented perpendicular to a second axis if the first axis is perpendicular to any plane containing the second axis, even if the first axis and the second axis do not intersect. The fact that Applicant may occasionally recite "parallel or coincident to" with respect to a pair of axes does not change this usage: "parallel to" means "parallel to or coincident with." The terminology defined in this paragraph includes the above-listed words, derivatives thereof and words of similar import.

Referring to FIGS. 3A through 10, a trigger assembly 120 is provided for mounting to a handgun 110. The handgun 110 has a firearm barrel 112, a small portion of which is visible in solid lines, with an additional, internal portion shown in dashed lines. The firearm barrel 112 is attached to a firearm frame 114. The handgun 110 has a muzzle 116. The firearm barrel 112 defines a longitudinal axis P extending parallel to the barrel 112. A vertical axis V is perpendicular to the longitudinal axis P and runs generally vertically when the handgun 120 is held in a conventional fashion with the barrel 112 parallel to the ground. A transverse axis T runs in a plane parallel to the axis P (that is, generally horizontally as shown in the figures) and perpendicular to the vertical axis V. The firearm has a trigger 122 surrounded by a trigger guard 260.

Figure 7:
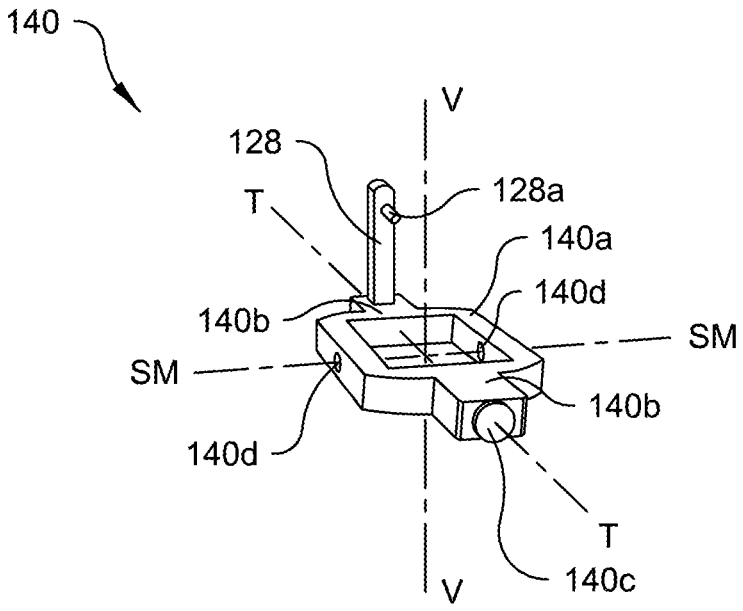
FIG. 7 is a left front perspective view of a support frame of the trigger assembly of the firearm of FIG. 3.
Figure 8:
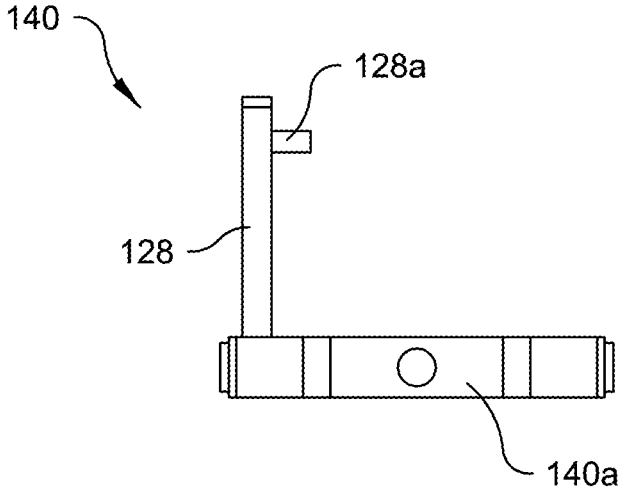
FIG. 8 is a left side elevational view of the support frame of FIG. 7.

Referring to FIGS. 4, 5, 7, and 9, the trigger assembly 120 includes a support frame 140 mounted to the firearm frame 114 by way of the casing 200. As best seen in FIG. 7, the support frame 140 has a generally rectangular or square planar frame portion 140*a*; other shapes may be used as well. The support frame 140 is pivotable with respect to the firearm frame 114 with respect to a transverse axis (in this case the transverse axis T) oriented perpendicular to the longitudinal axis P. The support frame 140 has two support-pin mounts in the form of two support-pin holes 140*d*, which are aligned with the longitudinal axis SM.

A support member in the form of a support pin 160 (FIG. 9) is mounted to the support frame 140, with the support-pin holes 140*d* in the illustrated embodiment, for movement therewith and for pivoting with respect to the support-member axis SM. In a resting position of the trigger 122, the support-member axis SM may be preferably oriented parallel to the longitudinal axis P or may be oriented roughly parallel to the longitudinal axis P.

Figure 4:
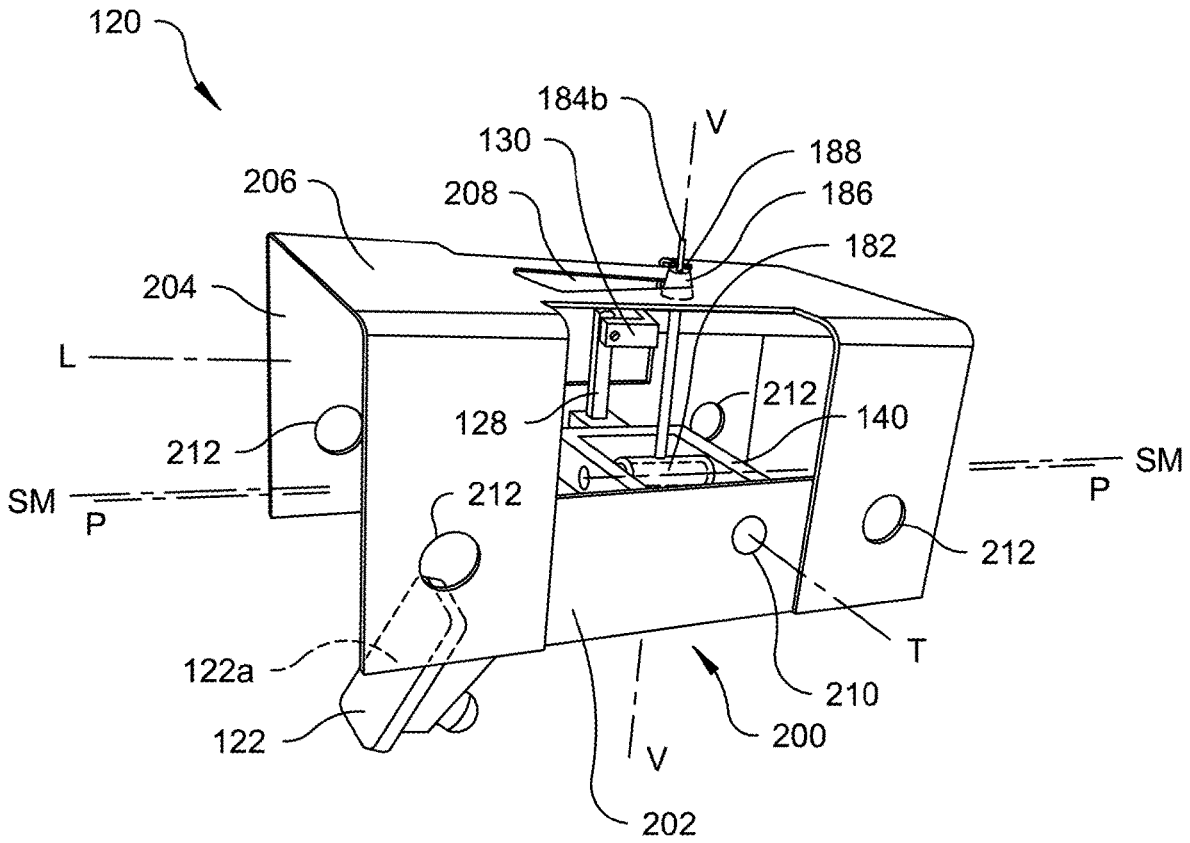
FIG. 4 is a left front perspective view of a trigger assembly of the firearm of FIG. 3.

A trigger-bar actuator 128 extends from the support frame 140 and is fixed thereto. The trigger-bar actuator 128 is connectable to a trigger bar 130 (FIG. 4), which initiates firing of the handgun 110 upon a movement of the trigger 122 and consequent rotation of the support frame 140 about the transverse axis T. In the embodiment shown, the trigger-bar actuator 128 has a trigger-bar pin 128*a* for connecting to the trigger bar 130, a portion of which is shown in FIG. 4. The planar frame portion 140*a* may have a pair of oppositely mounted transverse support protrusions 140*b*, each of which may carry a transverse support peg 140*c*. The transverse support pegs 140*c* fit into support-frame holes 210, which are further described below, so that the support frame 140 is mounted to the firearm frame 114 for rotation about the transverse axis T, as best seen in FIG. 4.

Figure 6:
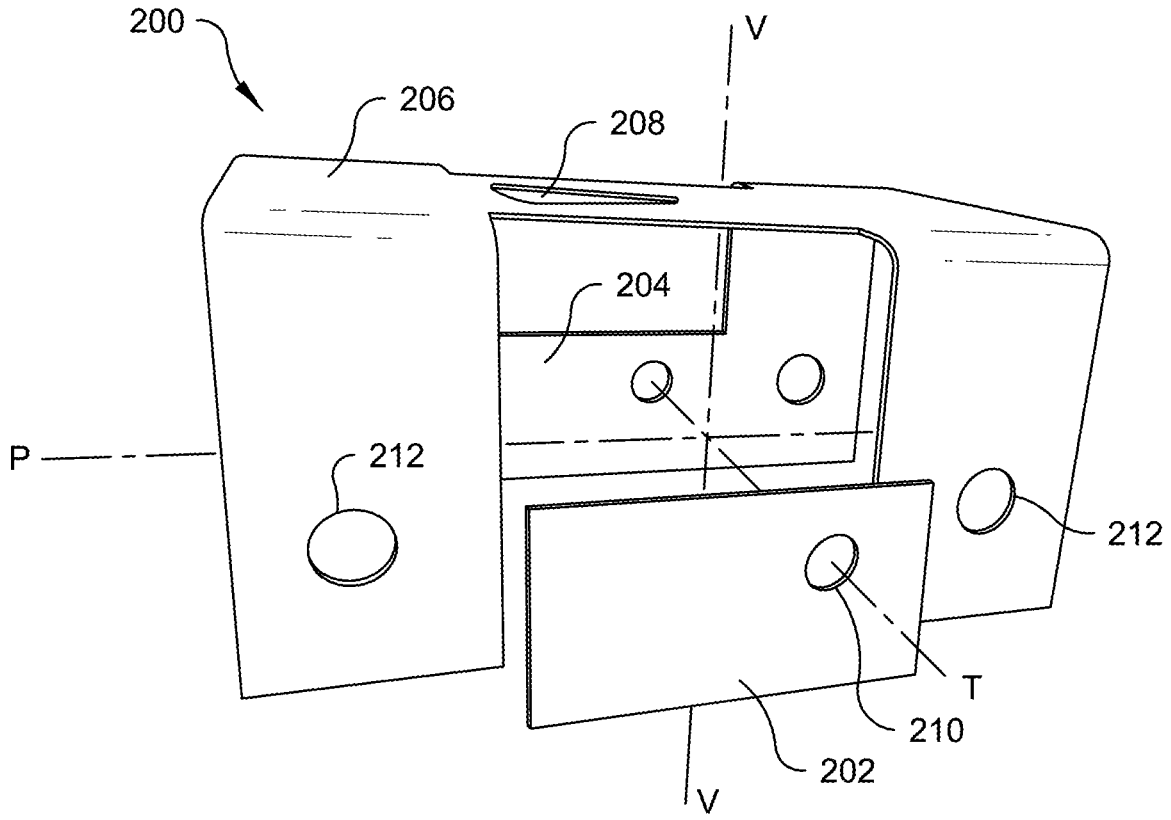
FIG. 6 is a left upper exploded perspective view of a casing of the trigger assembly of the firearm of FIG. 3.

Referring to FIGS. 4 and 6, a casing 200 is provided for mounting to the firearm frame 114 (or to or within any suitable firearm frame or structure) and includes a first longitudinally oriented frame member 202 oriented parallel to the longitudinal axis P; and a second longitudinally oriented frame member 204 in spaced and parallel relation to the first longitudinally oriented frame member 202. A pair of support-frame mounts in the form of support-frame holes 210 are located on transversely opposite sides of the casing 200. The support-frame holes 210 accept the transverse support pegs 140*c* of the support frame 140, so that the support frame 120 is mounted for rotation about the transverse axis T with respect to the casing 200. The casing 200 also has firearm-frame-mounting holes 212 accommodating casing pins (not shown) for mounting the casing to the firearm frame 114. As shown in FIG. 6, the first longitudinally oriented frame member 202, or a portion thereof, may be formed separately from the remainder of the casing 200 to facilitate assembly of the trigger assembly 120.

Figure 9:
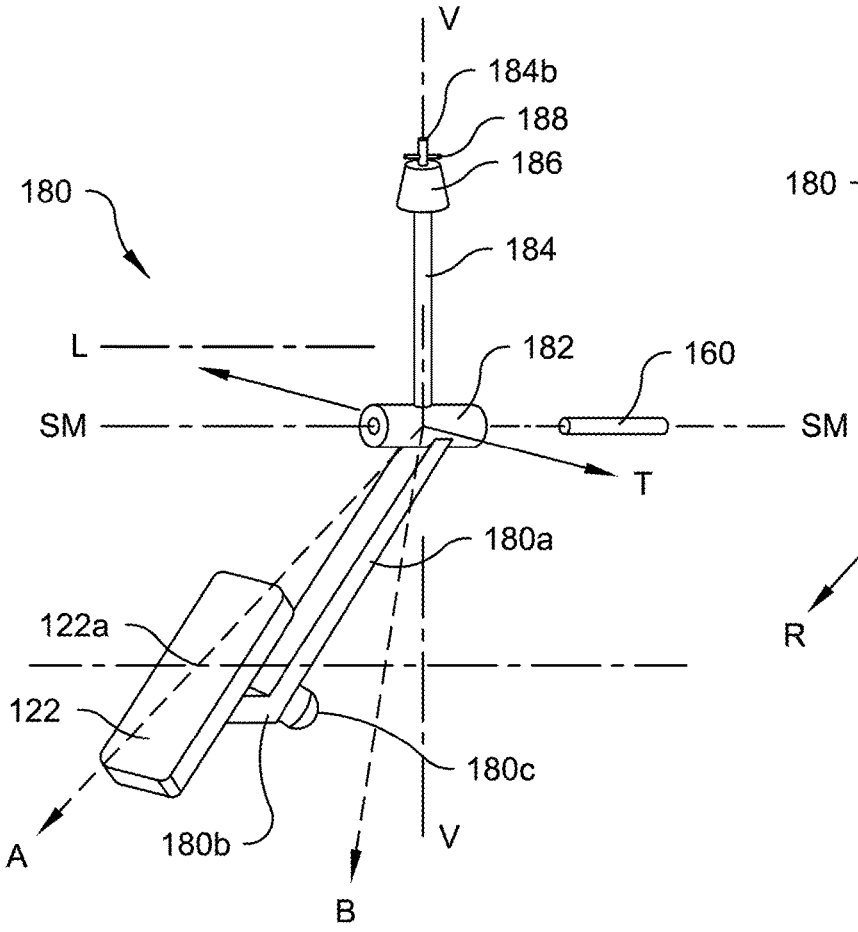
FIG. 9 is a front left perspective view of a trigger arm of the trigger assembly of the firearm of FIG. 3.
Figure 10:
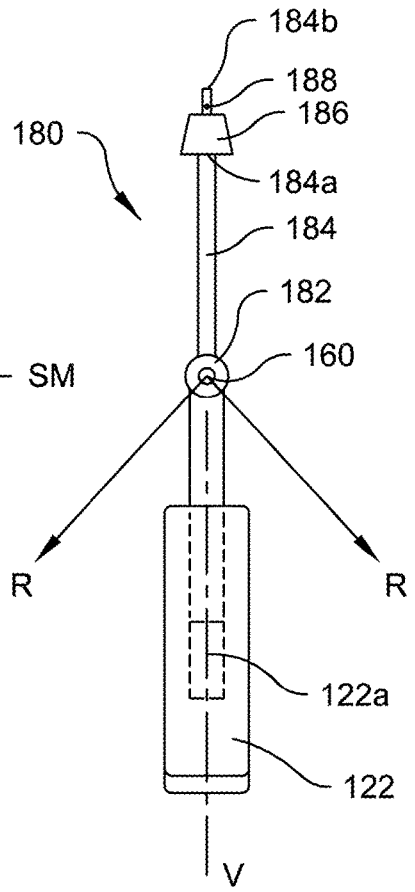
FIG. 10 is a front elevational view of the trigger arm of FIG. 9.

Referring to FIGS. 9-12 and particularly to FIGS. 9 and 10, a trigger arm 180 is mounted to the support pin 160 and is pivotable with respect to the support pin 160 about the support-member axis SM. The trigger arm 180 includes a bearing member in the form of a sleeve 182 surrounding and encompassing the support pin 160. Other types of bearing, such as a roller bearing sealed with lubrication therein and the like capable or rotatably supporting the trigger arm 180, may be used to support the trigger arm 180 in the support frame 140. The trigger arm 180 includes a trigger support portion 180*a* extending away from the sleeve 182 at least in a direction perpendicular to the support-member axis SM and the transverse axis T. As a result, the trigger arm 180 extends away from the support pin 160 at least in a direction perpendicular to the support-member axis SM and the transverse axis T. That is, when the support-member axis SM and the transverse axis T are oriented generally horizontally, the trigger arm 180, and in particular to the trigger support portion 180*a* thereof, extends at least partially downwardly with respect to the support-member axis SM and the transverse axis T. In the illustrated embodiment, the trigger support portion 180*a* has an angled portion 180*b*. The trigger arm 180 may carry a rearwardly oriented trigger-arm bumper 180*c*, which may preferably be a generally convex rounded element extending from the trigger arm 180, and which may optionally act to protect other components, as described below, when a user rotates the trigger 122 past the firing position.

Figure 11:
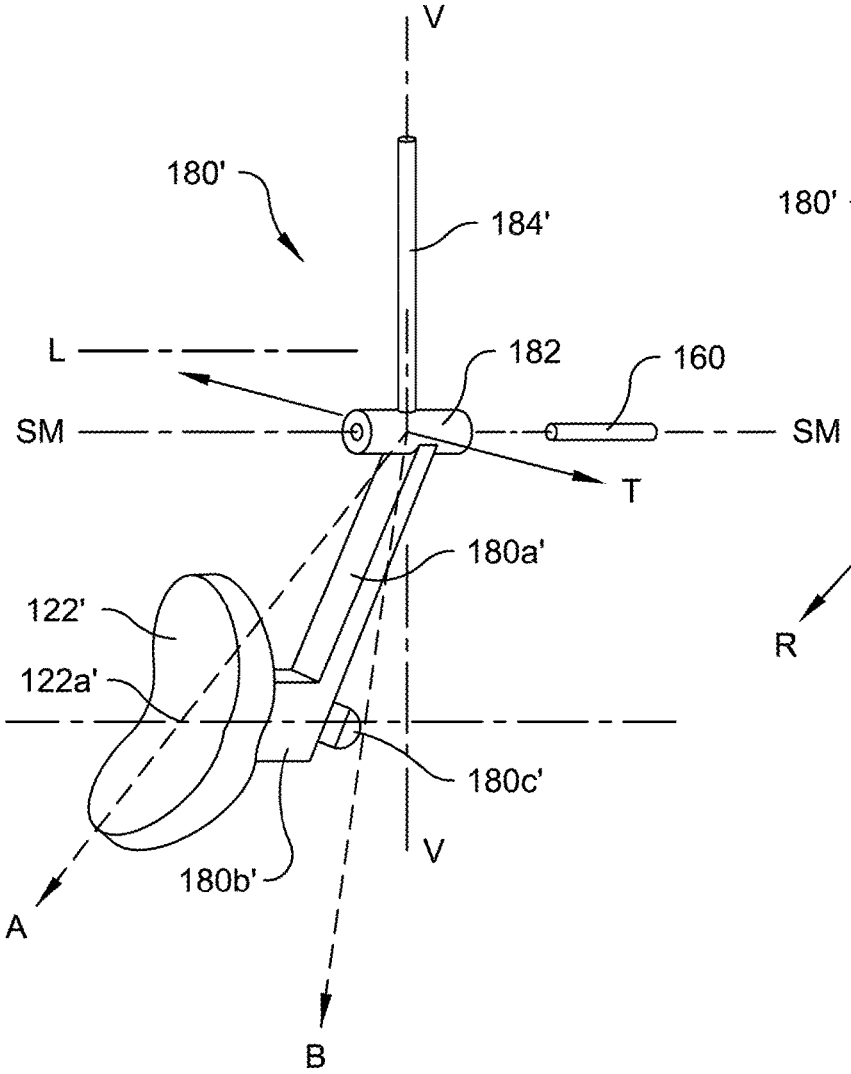
FIG. 11 is a front left perspective view of an alternative trigger arm for the trigger assembly of the firearm of FIG. 3.
Figure 12:
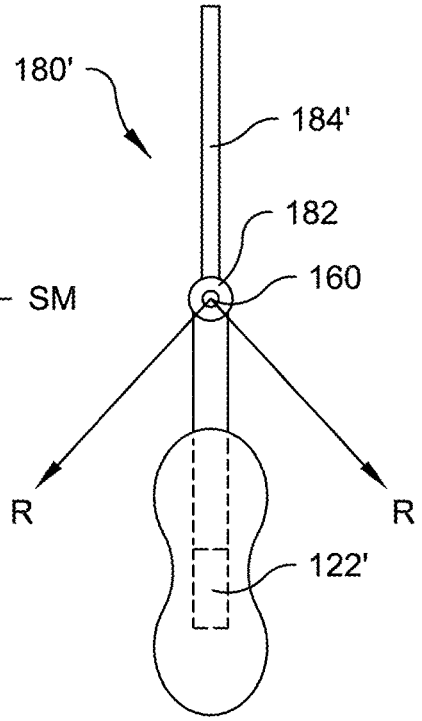
FIG. 12 is a front elevational view of the trigger arm of FIG. 11.

Referring to FIGS. 11 and 12, a second embodiment of a trigger arm 180' supports a second embodiment of a trigger 122' with a center point 122*a*'. The trigger arm 180' is mounted to the support pin 160 and is pivotable with respect to the support pin 160 about the support-member axis SM. The trigger arm 180' includes a bearing member in the form of a sleeve 182 surrounding and encompassing the support pin 160. Other types of bearing, such as a roller bearing sealed with lubrication therein and the like capable or rotatably supporting the trigger arm 180', may be used to support the trigger arm 180' in the support frame 140. The trigger arm 180' includes a trigger support portion 180*a*' extending away from the sleeve 182 at least in a direction perpendicular to the support-member axis SM and the transverse axis T. As a result, the trigger arm 180' extends away from the support pin 160 at least in a direction perpendicular to the support-member axis SM and the transverse axis T. That is, when the support-member axis SM and the transverse axis T are oriented generally horizontally, the trigger arm 180', and in particular to the trigger support portion 180*a*' thereof, extends at least partially downwardly with respect to the support-member axis SM and the transverse axis T. In the illustrated embodiment, the trigger support portion 180*a*' has an angled portion 180*b*'. The trigger arm 180 may carry a rearwardly oriented trigger-arm bumper 180*c*', which may preferably be a generally convex rounded element extending from the trigger arm 180', and which may optionally act to protect other components, as described below, when a user rotates the trigger 122' past the firing position.

Referring to FIGS. 9-12, the trigger 122, 122' is supported on the trigger arm 180 for movement with the trigger arm 180 about the support-member axis SM. As a result, the trigger 122, 122' may rotate side-to-side with respect to the handgun 110 as the user squeezes the trigger 122, 122' rearwardly to operate the handgun 110, as shown by the arrows R, R in FIGS. 10 and 12. Squeezing the trigger 122, 122' rearwardly causes the support frame 140 to rotate about the transverse axis T. The trigger 122, 122' has a resting position, consistent with the arrow A in FIGS. 9 and 11 and the position of the trigger 122 shown in FIG. 3A. The trigger 122, 122*a* also has an activated position or firing position, which is the point in a rearward path of the trigger 122, 122' at which the handgun 110 fires; the activated position is determined by the position, consistent with the arrow B in FIGS. 10, 12 and the trigger position shown in FIG. 3B, at which the support frame 140 is rotated sufficiently that the trigger-bar actuator 128 initiates firing of the handgun 110. The activated position or firing position may be reached with the trigger 122, 122' rotated across a range of positions with respect to the support-member axis SM to accommodate the user. The trigger 122, 122' has a center point 122*a*, 122*a*'. The handgun 110 may have a trigger stop 114*a* (FIGS. 3A and 3B) positioned so that the trigger stop 114*a* may contact the trigger arm 180, 180' or preferably the trigger-arm bumper 180*c*, 180*c*' after the trigger 122, 122' rotates past the firing position. The trigger stop 114*a* may be flat or curved in any convenient shape to provide a potential point of contact for the trigger arm 180, 180' or trigger-arm bumper 180*c*, 180*c*', and may preferably be made from a metal or rigid composite material. The trigger stop 114*a* and the trigger-arm bumper 180*c*, 180*c*' are preferably dimensioned and aligned so that the trigger 122, 122' stops rotating just past the firing position, in order to limit overtravel of the trigger 122, 122' as much as possible, allowing the handgun 110 to be ready for additional firing quickly. In the resting position (FIG. 3A), the trigger 122, 122' is at an initial angle with respect to the vertical axis V; as the trigger moves rearwardly, the trigger 122, 122' is rotated toward an orientation parallel to the vertical axis V. The trigger 122, 122' support frame 140, and trigger arm 180, 180' are preferably dimensioned and supported so that when the trigger 122, 122' reaches the firing position, the trigger support portion 180*a*, 180' and/or the trigger 122, 122' has not yet become vertical, or at most has just become vertical and has not begun to travel upwardly.

In certain embodiments, the rotation of the trigger 122, 122' about the support-member axis SM provides an enhanced accommodation of the user as the handgun is fired, increasing the user's comfort and accuracy in operating the handgun 110. The trigger arm 180, 180' may include an upwardly extending portion 184, 184' which in the illustrated embodiment extends upwardly from the sleeve 182. The upwardly extending portion 184 may have a shoulder 184*a* (FIG. 10) and a spindle portion 184*b* rotatably supporting a frustoconical roller 186; alternatively, the upwardly extending portion 184' may omit these features, as shown in FIGS. 11 and 12. As shown in FIGS. 9 and 10, a roller-securing element in the form of a roller-securing pin 188 may secure the roller 186 on the spindle portion 184*b*.

Figure 5A:
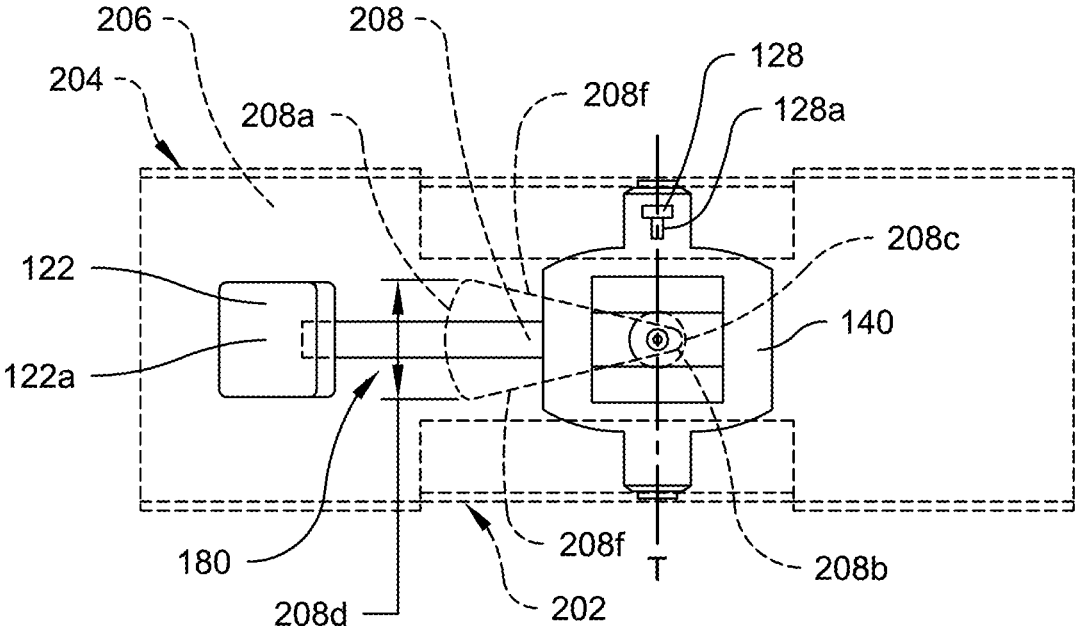
FIG. 5A is a top plan view of the trigger assembly of the firearm of FIGS. 3A and 3B.
Figure 5B:
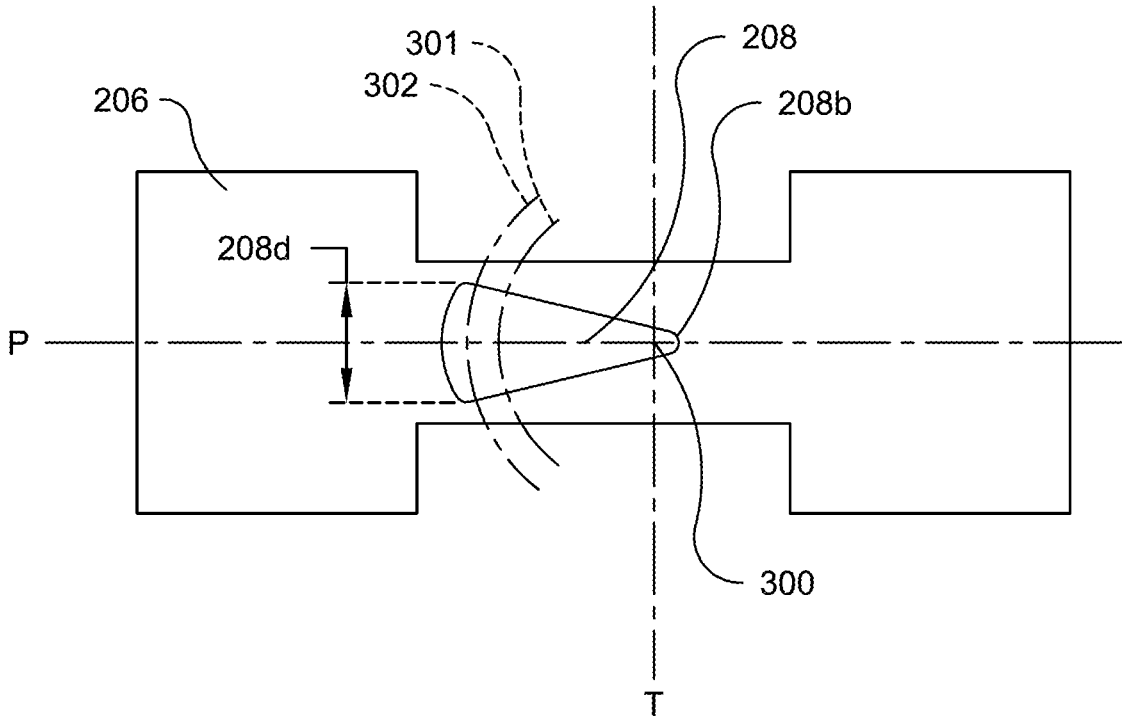
FIG. 5B is a simplified, schematic top plan partial view of the trigger assembly of FIG. 3, showing the position of an upwardly extending portion 184 of the trigger arm 180.

Referring again to FIGS. 4-6, the trigger assembly 120 also includes a catch mechanism limiting the pivoting motion of the trigger arm 180, 180' with respect to the support-member axis SM, the operation of which is described with respect to the trigger arm 180 but is equally applicable to the trigger arm 180'. Preferably the catch mechanism will not generally touch or affect the trigger arm 180 in movement thereof from the resting position to the firing position; the trigger arm 180 preferably moves freely but without play and is limited by the catch mechanism to protect other components of the firearm 110 from damage. In the illustrated embodiment, the catch mechanism takes the form of a catch base formed by an upper member 206 of the casing 200. The upper member 206 has a catch-base aperture 208. The upwardly-extending portion 184 of the trigger arm 180 extends through the catch-base aperture 208. The catch-base aperture 208 may preferably have the shape of a sector of a circle, with a preferred alternative being a generally triangular shape with rounded corners; or the catch-base aperture 208 may have another suitable shape. The roller 186 may aid the movement of the upwardly-extending portion 184 within the catch-base aperture 208. The catch-base aperture 208 has a front end 208*a* aligned with the muzzle 116 and an opposite rear end 208*b*. The rear end 208*b* of the catch-base aperture 208 may have a radius 208*c* equal to an exterior dimension of the upwardly extending portion 184 of the trigger arm 180; in the illustrated embodiment, the exterior dimension is formed by an exterior surface of the roller 186. The catch-base aperture 208*a* has side walls 208*f* extending between the front end 208*a* and the rear end 208*b*. The front end 208*a*, the rear end 208*b*, and the side walls 208*f* act together to limit the movement of the upwardly extending portion 184 and the trigger arm 180. The front end 208*a* of the catch-base aperture 208 may have a transverse dimension 208*d* greater than or equal to two times the radius of the rear end 208*b*. As a result of the interaction between the roller 186 and the catch-base aperture 208, the degree of rotation of the trigger arm 180 is limited to different degrees during the movement of the trigger 122. When the trigger 122 is in the resting position, the trigger arm 184 rests in the rear 208*b* of the catch-base aperture 208, and the trigger arm 180 is substantially prevented from rotating about the axis SM. As the trigger 122 rotates rearwardly under control of the user, the upwardly extending portion 184 of the trigger arm 180 moves toward the wider front end 208*a*, allowing a greater degree of rotation about the axis SM. As best seen in FIG. 5B, the center of the upwardly extending arm 184 and the roller 186 (where present) is at a resting arm position 300 when the trigger is at rest, under no rotation from the hand of the user; the trigger 122 and attached hardware will normally return to the resting position when the user stops squeezing the trigger 122. Upon the user's squeezing the trigger 122 and causing rotation thereof, the center point of the upwardly extending arm 184 (which is also preferably the center point of the roller 186) moves with respect to the catch-base aperture 208 to an activated arm position 301 corresponding to the activated position of the trigger 122, and then to a bumper-stop contact arm position 302 at which the trigger 122 (and where present, the trigger-arm bumper 180*c*) contacts the trigger stop 114*a*. Note that the activated arm position 301 and the bumper-stop arm position 302 are arcs centered on the resting arm position 300; this is so because the trigger 122 may reach the activated position 301 and the bumper-stopper contact arm position 302 while the trigger 122 is rotated about the support pin 160 about the support-member axis SM. Following firing of the hand gun 110, the firing mechanism (not shown) rotates the support frame 140 back to the resting position. During the rotation of the support frame 140 back to the resting position, at least one of the side walls 208*f* of the catch-base aperture 208 may guide the upwardly extending arm 184 back to the resting position 300.

Note that the triggers 122, 122' may be interchanged at the user's preference on either trigger arm 180, 180'.

Figure 3A:
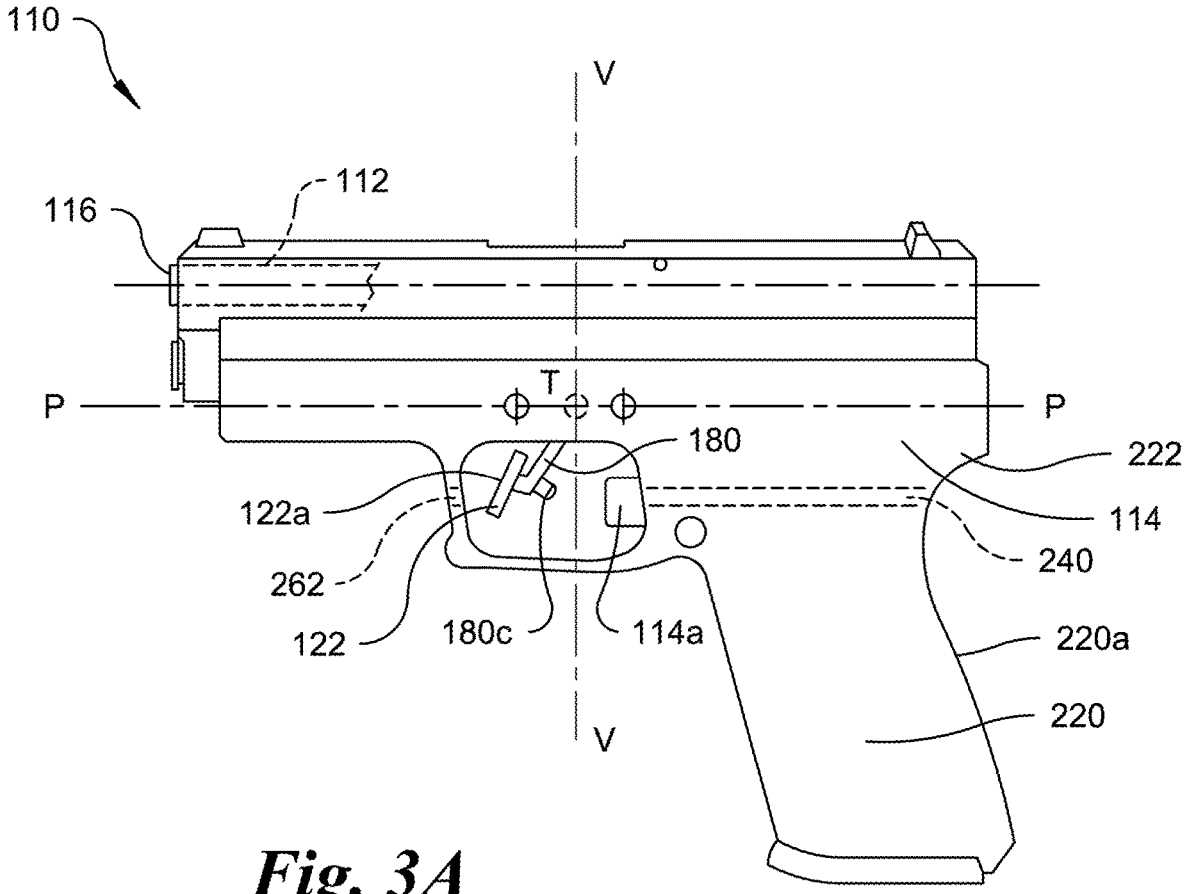
FIG. 3A is a left side schematic view of an example of a firearm according to one embodiment of the invention, with the trigger in a resting position.
Figure 3B:
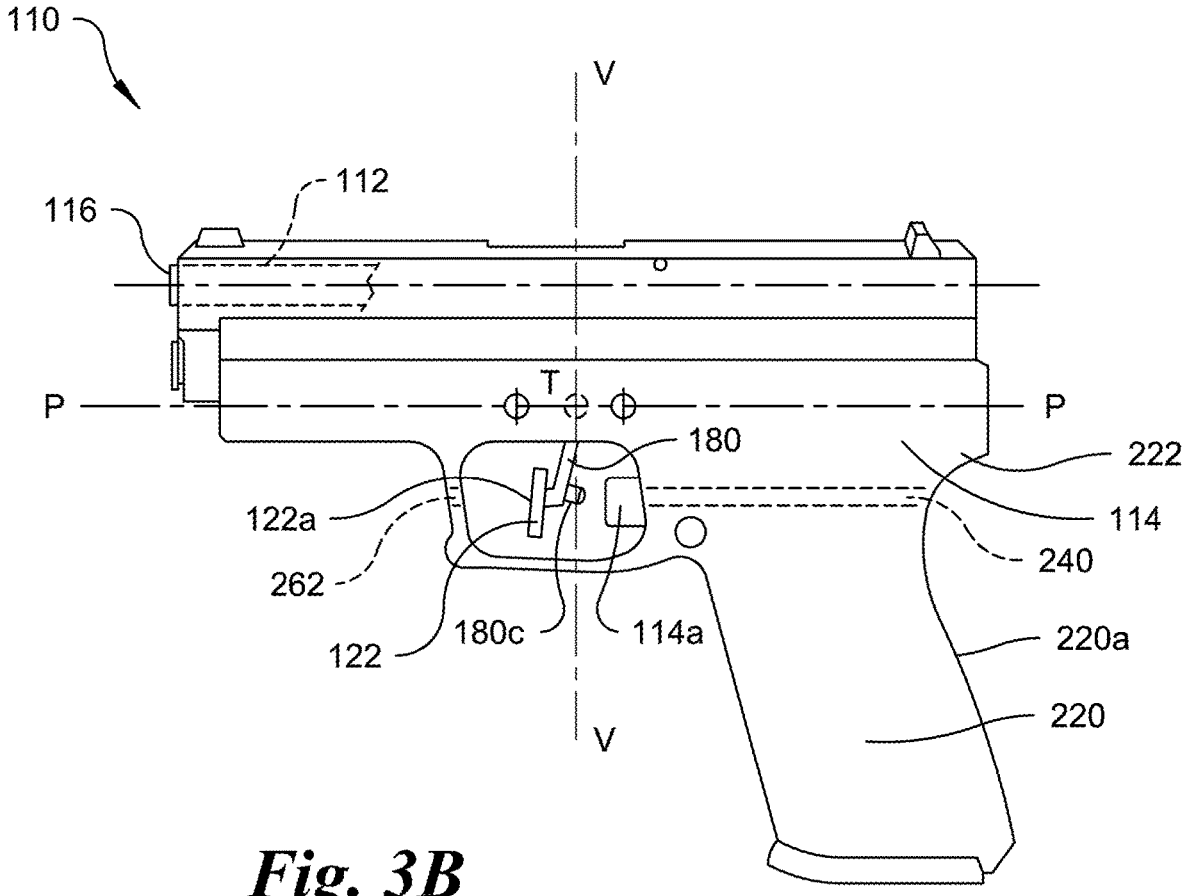
FIG. 3B is a left side schematic view of an example of a firearm according to one embodiment of the invention, with the trigger in a firing position—that is, the trigger has rotated to a position where firing of the firearm occurs.

Referring to FIG. 3A, in certain embodiments, a hand grip 220 as described herein is attached to the firearm frame 114. The hand grip 220 has a rearward portion 220*a* with an outwardly protruding hand guide 222. The hand guide 222 is located so that an index finger of a hand gripping the hand grip 220 and arranged adjacent to the hand guide 222 is aligned parallel to the firearm barrel 112 (and as a result, parallel to the axis P). In certain embodiments, the hand guide 222 is located so that a center line of the index finger of a hand gripping the hand grip 220 and arranged adjacent to the hand guide 222 is aligned parallel to the firearm barrel 112 (and as a result, parallel to the axis P) when the index finger is extended into an operating position covering the center point 122*a* of the trigger 122. In certain embodiments, a first direction indicator in the form of an index-finger guide line 240 is arranged upon the hand grip 220 and follows the index finger position from the outwardly protruding hand guide 222, across the grip covering the center point 122*a* (or other preferred "sweet spot" for the user's index finger on the trigger) and ends on the trigger guard 260. The index-finger guide line 240 may preferably extend parallel to the firearm barrel 112. Note that the precise dimensions of the hand grip 220 may be varied in accordance with the dimensions of a particular user's hand, so that the index finger may be placed as described above.

The trigger guard 260 has a second direction indictor in the form of a barrel guide alignment mark 262 arranged upon the trigger guard 260 in linear alignment with the barrel guide line 240. The barrel guide alignment mark 262 may be an extension of the barrel guide line 240. In the illustrated embodiment, the borders of the barrel guide line 240 and the barrel guide alignment mark 262 are shown as dashed lines. The barrel guideline 240 and the barrel guide alignment mark 262 may preferably be colored areas but may also take the form of areas that are etched, scored, knurled, or otherwise made visible to the user. Preferably the barrel guideline 240 and the barrel guide alignment mark 262 are formed with a smooth surface that is comfortable for the user. The barrel guideline 240 and the barrel guide alignment mark 262 may aid and encourage the user to grip the hand grip 220 "up high"—that is, with the user's hand(s) adjacent to and in contact with, or as close as possible to, the hand guide protrusion 222, in order to allow the user's index finger to extend comfortably or naturally to cover the center point 122*a* of the trigger 122.

As noted above, the triggers 122, 122' may be interchanged at the user's preference on either trigger arm 180, 180'; and any combination of trigger and trigger arm may be used with or without any combination of the barrel guideline 240 and the barrel guide alignment mark 262.

The trigger assembly 120 is mounted to the handgun 110, which has the firearm frame 114 and the firearm barrel 112. The trigger assembly 120 comprises the trigger 122, which mounted via the support frame 140 rotation for two-axis rotation about a first axis, axis T, transverse to the barrel 112 and a second axis, the support member axis SM, which may be parallel to or coincide with the longitudinal axis P, which is parallel to the firearm barrel 112.

All of the components described therein may preferably be made from materials such as metals and/or alloys known in the art to be suitable for operating parts of the firearm triggers and related portions of firearm firing mechanisms.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A trigger assembly for mounting to a firearm having a firearm frame and a firearm barrel, the firearm barrel defining a longitudinal axis, the trigger assembly comprising:

a support frame mounted to the firearm frame and pivotable with respect to the firearm frame with respect to a transverse axis oriented perpendicular to the longitudinal axis;

a support member mounted to the support frame for movement therewith and having a support-member axis;

a trigger-bar actuator extending from the support frame and fixed thereto;

a trigger arm mounted to the support member and pivotable with respect to the support member about the support-member axis, the trigger arm extending away from the support member at least in a direction perpendicular to the longitudinal axis and the transverse axis;

a trigger supported on the trigger arm for movement with the trigger arm about the support-member axis;

a casing comprising:

a first longitudinally oriented frame member oriented parallel to the longitudinal axis; and a second longitudinally oriented frame member in spaced and parallel relation to the first longitudinally oriented frame member, wherein the support-member axis is coincident with or parallel to the longitudinal axis.

2. The trigger assembly according to claim 1, further comprising:

a catch mechanism restraining the pivoting motion of the trigger arm with respect to the support-member axis.

3. The trigger assembly according to claim 2 wherein the support member comprises a support pin, and the trigger arm includes a bearing member in the form of a sleeve surrounding and encompassing the support pin.

4. The trigger assembly according to claim 3, wherein the catch mechanism includes a catch base having a catch-base aperture with at least a portion of the trigger arm extending therethrough.

5. The trigger assembly according to claim 4, wherein the firearm has a muzzle and the catch-base aperture has a front end aligned with the muzzle and an opposite rear end, and the rear end of the catch-base aperture has a radius equal to an exterior dimension of the portion of the trigger arm, and the front end of the catch-base aperture has a transverse dimension greater than two times the radius of the rear end.

6. A firearm comprising:

a firearm frame;

a firearm barrel defining a longitudinal axis; and a trigger assembly comprising:

a support frame mounted to the firearm frame and pivotable with respect to the firearm frame with respect to a transverse axis oriented perpendicular to the longitudinal axis;

a support member mounted to the support frame for movement therewith and having a support-member axis that is coincident with or oriented parallel to the longitudinal axis;

a trigger-bar actuator extending from the support frame and fixed thereto;

a trigger arm mounted to the support member and pivotable with respect to the support member about the support-member axis, the trigger arm extending away from the support member at least in a direction perpendicular to the longitudinal axis and the transverse axis; and a trigger supported on the trigger arm for movement with the trigger arm about the support-member axis; and a casing comprising:

a first longitudinally oriented frame member oriented parallel to the longitudinal axis; and a second longitudinally oriented frame member in spaced and parallel relation to the first longitudinally oriented frame member; and a hand grip attached to the firearm frame, the hand grip having a rearward portion with an outwardly protruding hand guide, the hand guide being located so that an index finger of a hand gripping the hand grip and arranged adjacent to the hand guide, with a center line of the index finger aligned with a center point of the trigger, is aligned parallel to the firearm barrel.

7. The firearm according to claim 6, further comprising:

a first direction indicator arranged upon the hand grip and extending parallel to the firearm barrel so that the index finger of the hand gripping the hand grip and arranged adjacent to the hand guide is aligned with the first direction indicator;

a trigger guard;

and a second direction indictor arranged upon the trigger guard in linear alignment with the first direction indicator.

8. The firearm according to claim 6, wherein the hand grip has a hand-grip axis perpendicular to the firearm barrel, an upper hand-grip end, and an lower hand-grip end, and the hand grip has a first length perpendicular to the hand-grip axis and adjacent to the hand guide and a second length perpendicular to the hand-grip axis and at a location downward with respect to the first length, the first length being greater than the second length.

9. The firearm according to claim 6, wherein the trigger has a resting position and an activated position at which the firearm fires, and wherein a first trigger-pull indicator aligns with respect to the trigger at the resting position and a second trigger-pull indicator aligns with respect to the trigger at the activated position.

10. The firearm according to claim 6, further comprising:

a catch mechanism restraining the pivoting motion of the trigger arm with respect to the support-pin axis.

11. The firearm according to claim 10, wherein the hand grip has a hand-grip axis, an upper hand-grip end, and an lower hand-grip end, and the hand grip has a first perimeter perpendicular to the hand-grip axis and adjacent to the hand guide and a second perimeter perpendicular to the hand-grip axis and at a location downward with respect to the first perimeter, the first perimeter being greater than the second perimeter.

12. The firearm according to claim 11, further comprising:

a first direction indicator arranged upon the hand grip and extending parallel to the barrel so that the index finger of the hand gripping the hand grip and arranged adjacent to the hand guide is aligned with the first direction indicator;

a trigger guard;

and a second direction indictor arranged upon the trigger guard in linear alignment with the first direction indicator.

13. The firearm according to claim 12, wherein the trigger has a resting position and an activated position at which the firearm fires, and wherein a first trigger-pull indicator aligns with respect to the trigger at the resting position and a second trigger-pull indicator aligns with respect to the trigger at the activated position.

* * * * *